US006948673B1

(12) United States Patent
Sato

(10) Patent No.: US 6,948,673 B1
(45) Date of Patent: Sep. 27, 2005

(54) MASTER ROLL AND A MASTER ROLL HOLDING APPARATUS

(75) Inventor: Mitsuo Sato, Shibata-machi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 764 days.

(21) Appl. No.: 09/645,585

(22) Filed: Aug. 25, 2000

(30) Foreign Application Priority Data

Aug. 26, 1999 (JP) ..... 11-239141
May 12, 2000 (JP) ..... 2000-140580

(51) Int. Cl.[7] ..... B65H 18/28
(52) U.S. Cl. ..... 242/160.4
(58) Field of Search ..... 242/160.4, 912, 242/609, 611.2, 596.7, 613.5; 206/389

(56) References Cited

U.S. PATENT DOCUMENTS 1,962,959 A * 6/1934 Kinloch ..... 242/160.4
2,859,656 A * 11/1958 Lemieux
3,126,234 A * 3/1964 Batlas et al.
4,659,031 A * 4/1987 Saraisky
5,356,093 A * 10/1994 Kewin
5,595,356 A * 1/1997 Kewin
5,640,904 A 6/1997 Sato et al.
5,657,944 A * 8/1997 Kewin
5,829,713 A * 11/1998 Kewin
6,334,587 B1 * 1/2002 Roder ..... 242/160.4
6,390,428 B1 * 5/2002 Oshima

FOREIGN PATENT DOCUMENTS

| | | |
|---|---|---|
| JP | 4-20608 | 5/1992 |
| JP | 5-290227 | 11/1993 |
| JP | 08-175707 | * 7/1996 |
| JP | 2863319 | 12/1998 |
| WO | WO 97/04967 | 2/1997 |

* cited by examiner

*Primary Examiner*—William A. Rivera
(74) *Attorney, Agent, or Firm*—Oblon, Spivak, McClelland, Maier & Neustadt, P.C.

(57) ABSTRACT

A master roll includes a cylindrical core, a long-formed stencil wound around the core, and a ring-like identity member inserted in at least one side of inner periphery of the core. The identity member has a feature according to a variety of the stencil. The feature of the identity member is identified by size of the identity member, inserted position of the identity member or the like, so that many varieties of the master roll can be easily manufactured. A master roll holding apparatus can hold the master roll.

21 Claims, 11 Drawing Sheets

PRIOR ART

MASTER ROLL AND A MASTER ROLL HOLDING APPARATUS

BACKGROUND OF THE INVENTION

1. Field of the Invention

The present invention relates to a master roll for a stencil and a master roll holding apparatus for holding the master roll.

2. Description of the Prior Art

A printing apparatus such as a stencil printer provides a stencil portion. The stencil portion holds a master roll, which is wound around a core such as paper core, with a master roll holding apparatus. The stencil portion makes a master by heating the stencil so as to generate stencil pattern. The stencil printer prints the image according to the stencil pattern while the stencil generated the stencil pattern is wound around a plate cylinder.

FIG. 19 is an elevational view in section of a conventional master roll 200 and a pair of flange plate 201 comprising a part of a master roll holding apparatus. A long-formed stencil 203 wound around a cylindrical paper core 202 forms the master roll 200. One sides of the flange plates 201 provides convex connectors 204, which is inserted into the inner periphery of the paper core 202. Another sides of the flange plates 201 provide support pins 205. The support pins 205 should be inserted into the support grooves (not shown) provided on the support tables (not shown) after the convex connectors 204 are inserted into the inner periphery of the paper core 202, when an operator desires the master roll to set on the master roll holding apparatus.

A master roll holding apparatus, which inserts a convex connector provided on the fixed flange into the core of the master roll so as to hold the master roll, is also known.

The master roll has a variety with respect to the size or the like. Thus, there may be proper master roll and improper master roll for each stencil printer. Then, it is hopeful to be able to easily confirm whether certain master roll is proper or improper, when the operator desires the master roll to use on certain stencil printer.

One simple solution for confirmation of proper or improper master roll is obtained by definition of the inner diameter "d" of the paper core in accordance with variety of the master roll.

Japanese laid open publication No. Hei 5-290227 discloses other solution of the same. This document shows identity marks, on the inner or outer periphery of the paper core, which can be detected by a sensor.

Japanese patent publication No. 2863319 discloses other solution of the same. This document shows printed identity marks, on the end of the master roll, which can be detected by a sensor.

Further, Japanese patent publication for opposition No. Hei 4-20605 discloses techniques for preventing reverse setting of the master roll on the master roll holding apparatus. This document shows the core whose both ends are projected from the ends of the stencil such as the projected amounts thereof are different each other.

Herein after, drawbacks of the above master roll will be described.

It is simple and easy understanding that the inner diameter "d" of the paper core is defined in accordance with variety of the master roll for confirmation of proper or improper master roll. However, this method requires manufacturing several variety of the core while the core is manufactured.

This is so complicated. Also many variety of the master roll cannot be obtained because the variation of the inner diameter "d" is not so many.

The method described in Japanese laid open publication No. Hei 5-290227 also requires manufacturing several variety of the paper core having the identity marks while the paper core is manufactured. It is supposed to print the identity marks after manufacturing the paper core by a printer, but the printer should be expensive.

The method described in Japanese patent publication No. 2863319 has a drawback that the marks may not be detected surely if the master roll is reused after detaching and attaching the used master roll.

A master roll holding apparatus described in Japanese patent publication for opposition No. Hei 4-20605 can prevent the reverse setting of the master roll, but cannot allow the master roll to confirm whether the master roll is proper or improper for the stencil printer.

SUMMARY OF THE INVENTION

Accordingly, an object of the present invention is to provide a master roll, which is capable of increasing variety of the same easily.

Another object of the present invention is to provide a master roll holding apparatus, which is capable of detecting whether a master roll is proper or improper for the master roll holding apparatus easily.

These objects of the present invention are achieved by the novel master roll and master roll holding apparatus of the present invention.

According to the novel master roll of the present invention, there are provided a cylindrical core, a long-formed stencil wound around the core, and a ring-like identity member inserted in at least one side of inner periphery of the core. Thus, it is easy to manufacture the master roll by winding the stencil around the core and inserting the identity member into the core. The identity member has feature according to variety of the stencil. The feature of the identity member is identified by size of the identity member, inserted position of the identity member or the like, so that many variety of the master roll can be easily manufactured. In case that the identity member identifies the feature by the inserted position, it is possible to insert the identity member into a side of the core, to insert the identity members into both sides of the core respectively, to dispose end of identity member at outside of the core, and to dispose the end of the identity member at inside of the core. In case that the identity member identifies the feature by the size, it is possible to define inner diameter of the identity member, and to define distance from the end of the identity member to an end of the core.

According to the novel master roll holding apparatus of the present invention, the master roll holding apparatus holds a master roll, the master roll comprising a cylindrical core, a long-formed stencil wound around the core, and a ring-like identity member inserted in at least one side of inner periphery of the core. The identity member has feature according to variety of the stencil. The feature of the identity member is identified by size of the identity member, inserted position of the identity member or the like. The master roll holding apparatus of the present invention includes a pair of master roll holding portions for holding both sides of a master roll, and a detector having feature according to the feature of the identity member provided on corresponding master roll so as to capable of determining whether the master roll is proper or improper for setting on the master roll holding portion. Accordingly, the detector is able to detect whether the master roll is proper or improper for setting on the master roll holding portion.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, in which.

DETAILED DESCRIPTION OF THE PREFERRED EMBODIMENTS

A first embodiment of the present invention is now explained with reference to FIGS. 1 and 2.

Figure 1:
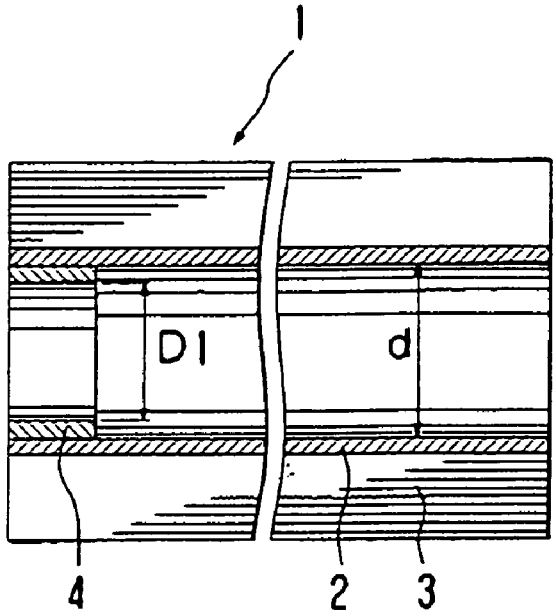
FIG. 1 is a longitudinal sectional view of a master roll according to first embodiment of the present invention.

FIG. 1 is a longitudinal sectional view of a master roll according to first embodiment of the present invention. The master roll 1 is formed by a cylindrical paper core 2 as a cylindrical core formed out of thick paper, a long-formed stencil 3 wound around the paper core 2, and a ring-like identity member 4 inserted into an inner periphery of the paper core 2 from a side thereof. The identity member 4 is adhered to the inner periphery of the paper core 2. An outside end of the identity member and an end of the paper core 2 are arranged on same surface. An inner diameter "D1" of the identity member is defined in 40 mm. The inner diameter "d1" of the core is defined in 50 mm. The identity member 4 is formed out of thick paper like the paper core 2 in consideration of recycling.

Figure 2:
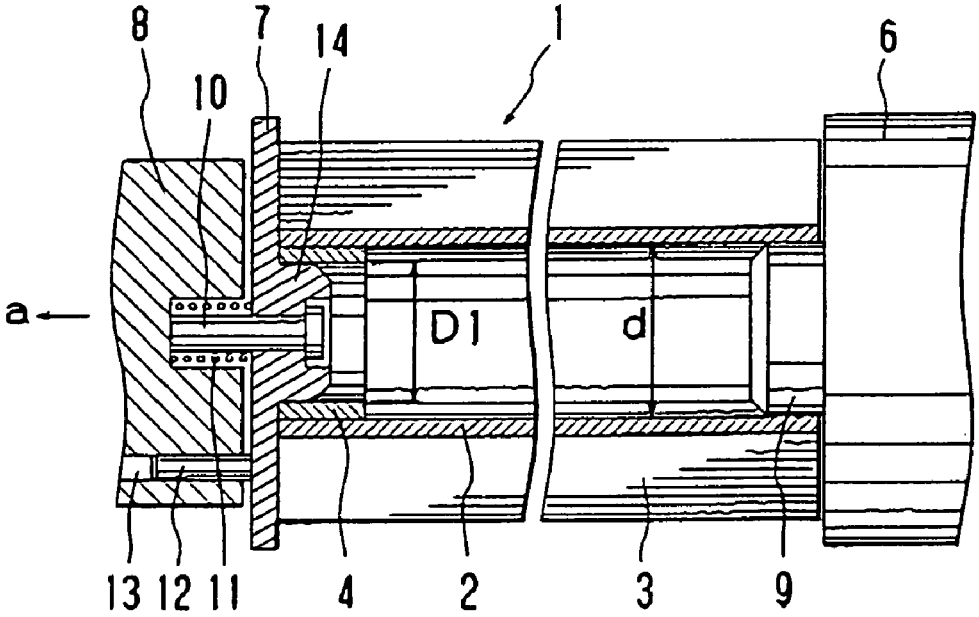
FIG. 2 is an elevational view in section of a master roll holding apparatus holding the master roll according to the first embodiment of the present invention.

FIG. 2 is an elevational view in section of a master roll holding apparatus holding the master roll according to the first embodiment of the present invention. The master roll holding apparatus provides a fixed flange 6, a movable flange 7, and a holder 8. The fixed flange 6 and the movable flange 7 comprise a pair of maser roll holding portion.

The fixed flange 6 includes a convex connector 9 as a detector. The convex connector 9 is inserted into the inner periphery of the paper core 2 when the pair of master roll holding portion holds the master roll 1. The convex connector 9 has a diameter that is slightly smaller than inner diameter "d" of the paper core 2 provided on corresponding master roll 1.

The holder 8 is movable from a holding position to a release position shown in arrow a in FIG. 2. The movable flange 7 is attached to the holder 8 through a guide rod 10 and a coil spring 11. The movable flange 7 is slidably attached to the guide rod 10 along an axis of the guide rod 10, and is urged to the master roll 1 by the coil spring 11 so as to give a stopping power to rotation of the master roll 1. The movable flange 7 provides a detent pin 12, which is inserted into a detent hole 13 provided on the holder 8 so as to prevent rotation of the movable flange 7.

The movable flange 7 provides a convex connector 14 at one side thereof. The convex connector 14 is inserted into the inner periphery of the identity member 4 when the pair of master roll holding portion holds the master roll 1. The convex connector 14 has a diameter that is slight smaller than inner diameter "D1" of the identity member 4 provided on corresponding master roll 1.

In operation, the master roll 1 is formed by wind of the stencil 3 around the paper core 2 and insertion of the identity member 4 into the inner periphery of the paper core 2, so that the master roll 1 can be easily manufactured. Many varieties of the master rolls 1, such as the master rolls 1 having different inner diameters of the identity members 4 but same other portions, also can be easily manufactured due to definition of the inner diameter "D1" of the identity member 4.

First of all, the holder 8 in the holding position shown in FIG. 2 should be released to the arrow a direction with the movable flange 7 so as to increase the distance between the movable flange 7 and the fixed flange 6, when an operator desires the master roll 1 to be held by the master roll holding apparatus. Next, the master roll 1 should be positioned between the fixed flange 6 and the movable flange 7. Then, the convex connectors 9 and 14 should be inserted into the inner periphery of the paper core 2 and the identity member 4 respectively while the holder 8 is returned to the holding position with the movable flange 7.

The master roll 1 defines the inner diameter "D1" of the identity member 4 in accordance with a stencil printer of which the master roll 1 is used. Thus, the convex connector 14 of the movable flange 7 provided on the master roll holding apparatus of the stencil printer can be smoothly inserted into the inner periphery of the identity member 4 of the master roll 1 without chatter, when the master roll 1 is proper for the stencil printer. Accordingly, it is easy to confirm whether the master roll 1 is proper or improper for the stencil printer.

Consequently, it can be prevented to do plate making and printing operation over from the very beginning after starting the plate making and printing while the improper master roll 1 for the stencil printer is held on the master roll holding apparatus of the stencil printer, so that the loss of the stencil 3 and time can be prevented.

Figure 3A:
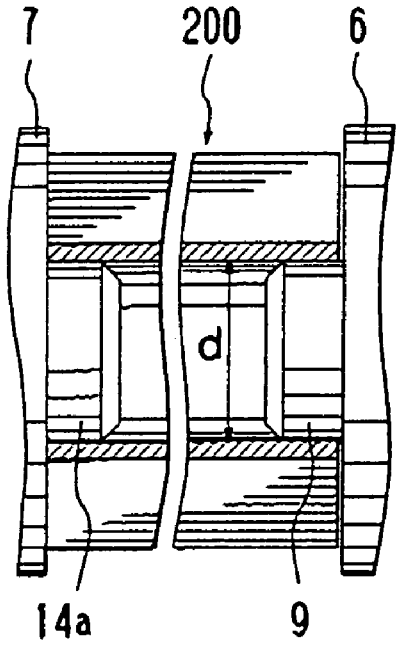
FIG. 3(A) is an elevational view in section of a conventional master roll holding apparatus holding the proper master roll.

FIGS. 3(A), (B), (C) and (D) show any statuses that the different varieties of master rolls 1 are held on the corresponding master roll holding apparatuses respectively.

FIG. 3(A) shows the status that the master roll 200 is held on the corresponding conventional master roll holding apparatus.

Figure 3B:
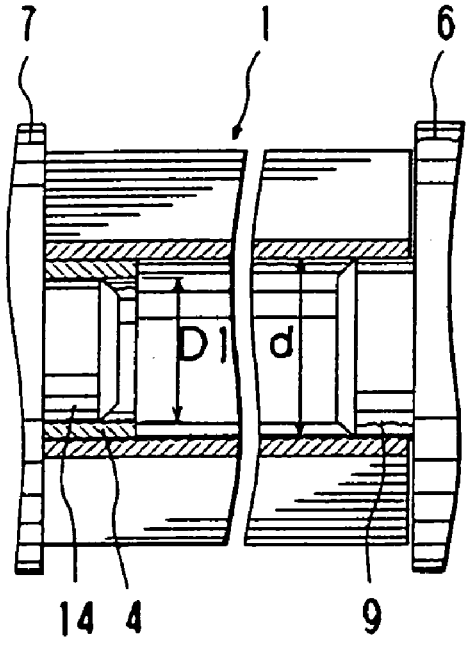
FIG. 3(B) is an elevational view in section of one example of the master roll holding apparatus holding the proper master roll according to the first embodiment of the present invention.

FIG. 3(B) shows the status that the master roll 1 of the present embodiment is held on the corresponding master roll holding apparatus.

Figure 3C:
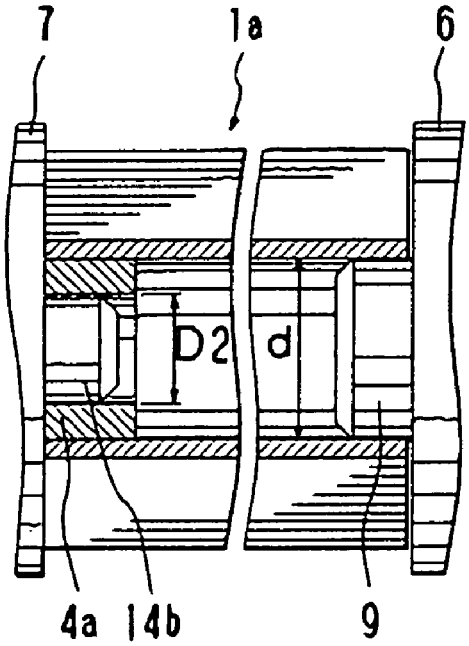
FIG. 3(C) is an elevational view in section of other example of the master roll holding apparatus holding the proper master roll according to the first embodiment of the present invention.

FIG. 3(C) shows the status that a master roll 1*a* having an identity member 4*a*, of which the inner diameter "D2" is 30 mm, is held on the corresponding master roll holding apparatus.

Figure 3D:
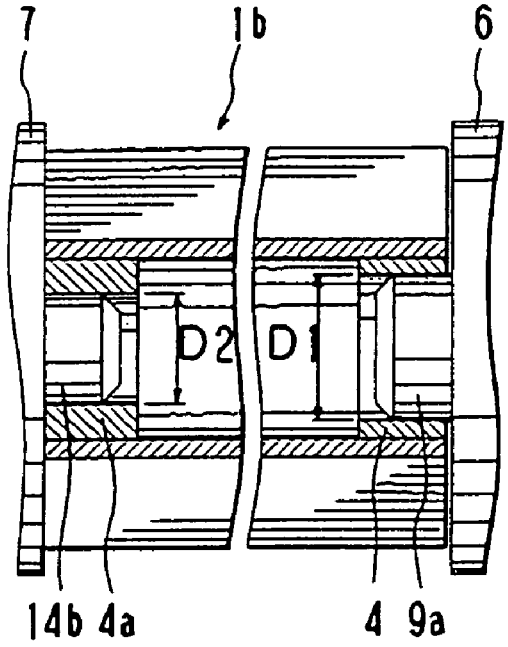
FIG. 3(D) is an elevational view in section of other example of the master roll holding apparatus holding the proper master roll according to the first embodiment of the present invention.

FIG. 3(D) shows the status that a master roll 1*b* having the identity member 4*a*, of which the inner diameter "D2" is 30 mm, at one side, and the identity member, of which the inner diameter "D1" is 40 mm, at another side, is held on the corresponding master roll holding apparatus.

In the master roll holding apparatus shown in FIG. 3(A), the convex connector 14*a* of the movable flange 7 and the convex connector 9 of the fixed flange 6 have the diameters which are slight smaller than the inner diameter "d" of the paper core 2 respectively.

In the master roll holding apparatus shown in FIG. 3(B), the convex connector 14*a* of the movable flange 7 has the diameter which is slight smaller than the inner diameter "D1" of the identity member 4, and the convex connector 9 of the fixed flange 6 has the diameter which is slight smaller than the inner diameter "d" of the paper core 2.

In the master roll holding apparatus shown in FIG. 3(C), the convex connector 14*b* of the movable flange 7 has the diameter which is slightly smaller than the inner diameter "D2" of the identity member 4*a*, and the convex connector 9 of the fixed flange 6 has the diameter which is slightly smaller than the inner diameter "d" of the paper core 2.

In the master roll holding apparatus shown in FIG. 3(D), the convex connector 14*b* of the movable flange 7 has the diameter which is slightly smaller than the inner diameter "D2" of the identity member 4*a*, and the convex connector 9 of the fixed flange 6 has the diameter which is slightly smaller than the inner diameter "D1" of the identity member 4.

A table 1 shows holding statuses of the master rolls 200, 1, 1*a* and 1*b* when the corresponding master roll holding apparatuses hold the master rolls 200, 1, 1*a* and 1*b* respectively. The table 1 also shows holding statuses of the master rolls 200, 1, 1*a* and 1*b* when the corresponding master roll holding apparatuses hold the master rolls 200, 1, 1*a* and 1*b* respectively in reverse direction. In the table 1, "○" shows that the master rolls 200, 1, 1*a* and 1*b* are held on the corresponding master roll holding apparatuses in proper respectively, "Δ" shows that the master rolls 200, 1, 1*a* and 1*b* are held on the corresponding master roll holding apparatuses respectively but with chatter, and "X" shows that the master rolls 200, 1, 1*a* and 1*b* can not be held on the corresponding master roll holding apparatuses respectively.

TABLE 1

| | | HOLDING DIRECTION | MASTER ROLL HOLDING APPARATUS FIG. 3(A) | FIG. 3(B) | FIG. 3(C) | FIG. 3(D) |
|---|---|---|---|---|---|---|
| MASTER ROLL | FIG. 3(A) | RIGHT | ○ | Δ | Δ | Δ |
| | | REVERSE | ○ | Δ | Δ | Δ |
| | FIG. 3(B) | RIGHT | X | ○ | Δ | Δ |
| | | REVERSE | X | X | X | Δ |
| | FIG. 3(C) | RIGHT | X | X | ○ | Δ |
| | | REVERSE | X | X | X | X |
| | FIG. 3(D) | RIGHT | X | X | X | ○ |
| | | REVERSE | X | X | X | X |

As apparent in the table 1, the master roll 1 having the identity member 4 shown in FIG. 3(B) can prevent improper set to the conventional master roll holding apparatus shown in FIG. 3(A). The master roll 1*a* having the identity member 4*a* shown in FIG. 3(C) can prevent improper set to the master roll holding apparatus shown in FIGS. 3(A) and (B). The master roll 1*b* having the identity members 4 and 4*a* shown in FIG. 3(D) can prevent improper set to the master roll holding apparatus shown in FIGS. 3(A), (B) and (C).

Further, the master rolls 1, 1*a* and 1*b* having the identity members 4, 4*a* and 4*b* almost can prevent reverse set to the master roll holding apparatus.

A second embodiment of the present invention is now explained with reference to FIGS. 4 and 5. The same parts as those in the first embodiment are designated by the same reference numerals, and are not again explained herein.

Figure 4:
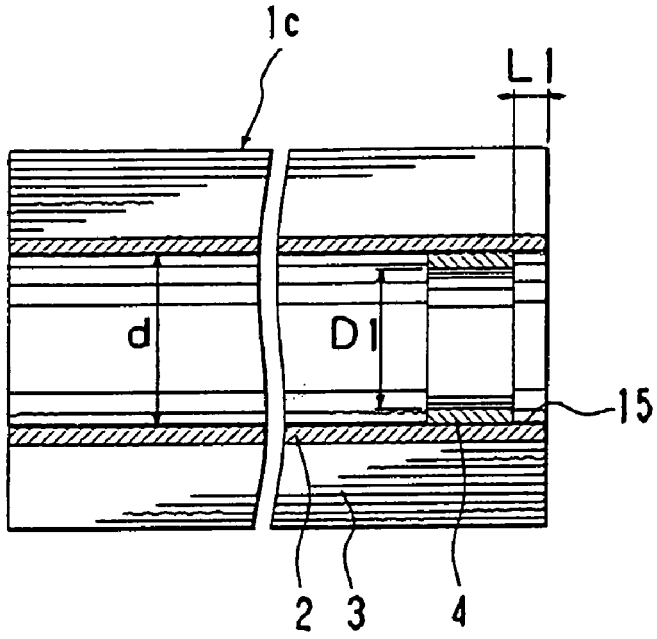
FIG. 4 is an elevational view in section of a master roll according to second embodiment of the present invention.

FIG. 4 is an elevational view in section of a master roll 1*c* according to second embodiment of the present invention. The master roll 1*c* is formed by a cylindrical paper core 2 as a cylindrical core formed out of thick paper, a long-formed stencil 3 wound around the paper core 2, and a ring-like identity member 4 inserted into an inner periphery of the paper core 2 from a side thereof. The identity member 4 is adhered to the inner periphery of the paper core 2.

The identity member 4 locates the end portion thereof in the inner periphery of the paper core 2 with certain amount so as to make a connecting step 15 from the end of the paper core 2 to the end of the identity member 4. The identity member 4 defines its inner diameter "D1" as 40 mm. The connecting step 15 defines its depth "L1" as 10 mm.

Figure 5:
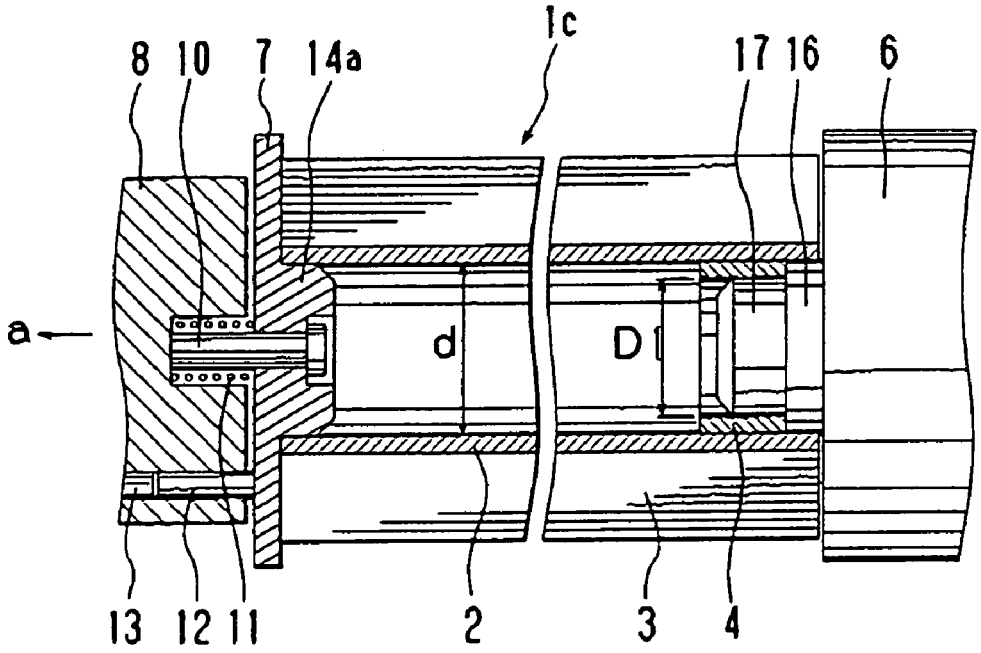
FIG. 5 is an elevational view in section of a master roll holding apparatus holding the master roll according to the second embodiment of the present invention.

FIG. 5 is an elevational view in section of a master roll holding apparatus holding the master roll 1*c* according to the second embodiment of the present invention. The master roll holding apparatus includes a fixed flange 6 as a master roll holding portion, a movable flange 7, and a holder 8.

The fixed flange 6 provides a first convex connector 16 as a detector and a second convex connector 17 as the detector. The first convex connector 16 is inserted into the inner periphery of the connecting step 15 when the master roll holding apparatus holds the master roll 1*c*. The first convex connector 16 has a diameter that is slight smaller than the inner diameter "d" of the paper core 2. The first convex connector 16 also has a length that is almost same to the depth "L1" of the connecting step 15. The second convex connector 17 is inserted into the inner periphery of the identity member 4 when the master roll holding apparatus holds the master roll 1*c*. The second convex connector 17 has a diameter that is slight smaller than the inner diameter "D1" of the identity member 4.

The movable flange 7 attached to the holder 8 provides a convex connector 14*a*. The convex connector 14*a* is inserted into the inner periphery of the paper core 2 when the master roll holding apparatus holds the master roll 1*c*. The convex connector 14*a* has a diameter that is slight smaller than the inner diameter "d" of the paper core 2.

In operation, the master roll 1*c* is formed by wind of the stencil 3 around the paper core 2 and insertion of the identity member 4 into the inner periphery of the paper core 2, so that the master roll 1*c* can be easily manufactured. Many varieties of the master rolls 1*c*, such as the master rolls 1*c* having different inner diameters of the identity members 4 but same other portions, also can be easily manufactured due to definition of the inner diameter "D1" of the identity member 4.

First of all, the holder 8 in the holding position shown in FIG. 5 should be released to the arrow a direction with the movable flange 7 so as to increase the distance between the movable flange 7 and the fixed flange 6, when the operator desires the master roll 1*c* to be held by the master roll holding apparatus. Next, the master roll 1*c* should be positioned between the fixed flange 6 and the movable flange 7. Then, the first and second convex connectors 16 and 17 of the fixed flange 6 should be inserted into the inner periphery of the paper core 2 and the identity member 4 respectively. The convex connector 14*a* of the movable flange 7 also should be inserted into the inner periphery of the paper core 2 while the holder 8 is returned to the holding position with the movable flange 7.

The master roll 1*c* defines the inner diameter "D1" of the identity member 4 and the depth "L1" of the connecting step 15 in accordance with a stencil printer, of which the master roll 1*c* is used. Thus, the second convex connector 17 of the fixed flange 6 provided on the master roll holding apparatus of the stencil printer can be smoothly inserted into the inner periphery of the identity member 4 of the master roll 1*c* without chatter, also the first convex connector 16 of the fixed flange 6 provided on the master roll holding apparatus of the stencil printer can be smoothly inserted into the inner periphery of the paper core 2 of the master roll 1*c* without chatter, when the master roll 1*c* is proper for the stencil printer. Accordingly, it is easy to confirm whether the master roll 1 is proper or improper for the stencil printer.

Consequently, it can be prevented to do plate making and printing operation over from the very beginning after starting the plate making and printing while the improper master roll 1*c* for the stencil printer is held on the master roll holding apparatus of the stencil printer, so that the loss of the stencil 3 and time can be prevented.

Figure 6A:
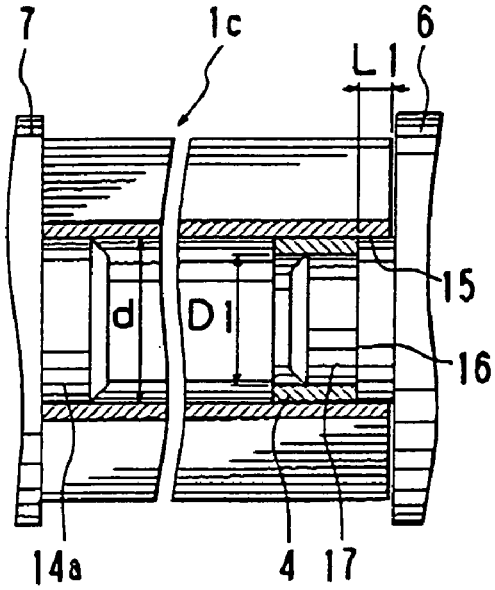
FIG. 6(A) is an elevational view in section of one example of the master roll holding apparatus holding the proper master roll according to the second embodiment of the present invention.

FIGS. 6(A), (B), (C) and (D) show any statuses that the different varieties of master rolls 1*c* are held on the corresponding master roll holding apparatuses respectively.

FIG. 6(A) shows the status that the master roll 1*c* of the present embodiment is held on the corresponding master roll holding apparatus.

Figure 6B:
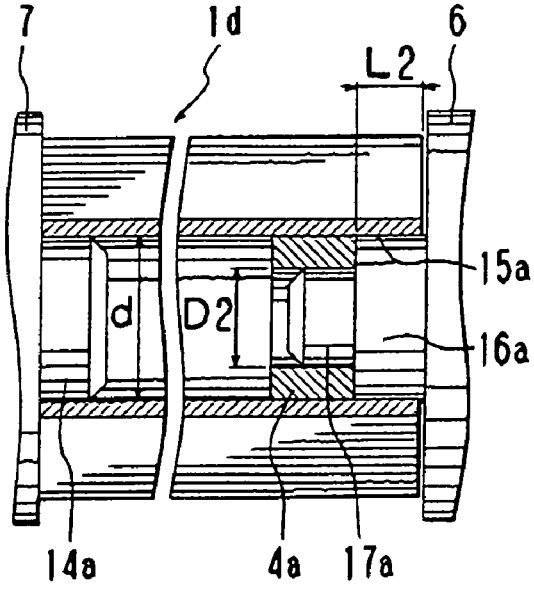
FIG. 6(B) is an elevational view in section of another example of the master roll holding apparatus holding the proper master roll according to the second embodiment of the present invention.

FIG. 6(B) shows the status that a master roll 1*d* having an identity member 4*a*, of which the inner diameter "D2" is 30 mm, and a connecting step 15*a*, of which the depth "L2" is 20 mm, is held on the corresponding master roll holding apparatus.

Figure 6C:
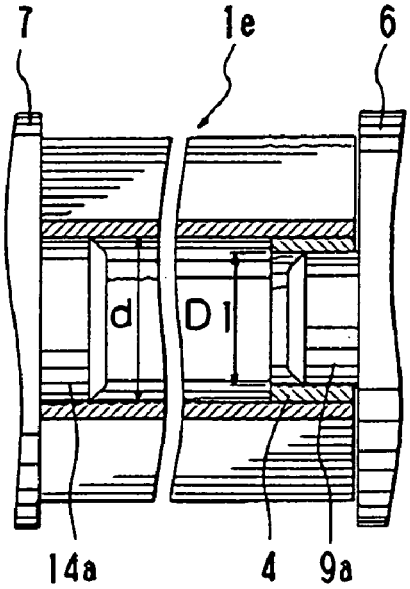
FIG. 6(C) is an elevational view in section of one example of the master roll holding apparatus holding the proper master roll according to the second embodiment of the present invention.

FIG. 6(C) shows the status that a master roll 1*e* without the connecting step 15 is held on the corresponding master roll holding apparatus.

Figure 6D:
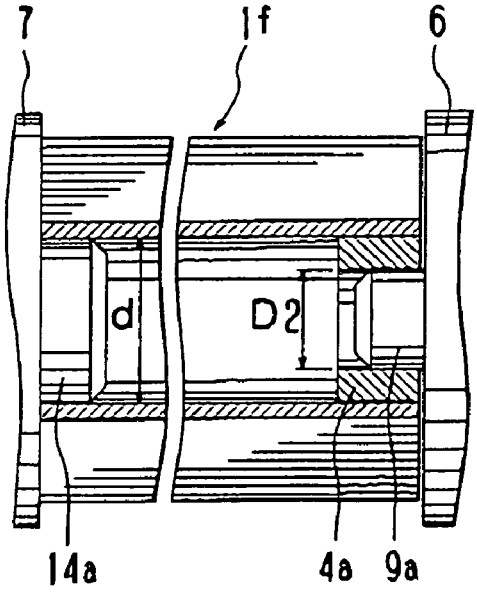
FIG. 6(D) is an elevational view in section of another example of the master roll holding apparatus holding the proper master roll according to the second embodiment of the present invention.

FIG. 6(D) shows the status that a master roll 1*f* without the connecting step 15 is held on the corresponding master roll holding apparatus.

In the master roll holding apparatus shown in FIG. 6(B), the second convex connector 17*a* of the fixed flange 6 has the diameter which is slight smaller than the inner diameter "D2" of the identity member 4*a*, and the first convex connector 16*a* of the fixed flange 6 has the height which is almost equal to the depth "L2" of the connecting step 15*a*.

In the master roll holding apparatus shown in figure 6(C), the fixed flange 6 provides a convex connector 9*a* having the diameter which is slight smaller than the inner diameter "D1" of the identity member 4.

In the master roll holding apparatus shown in FIG. 6(D), the fixed flange 6 provides a convex connector 9*b* having the diameter which is slight smaller than the inner diameter "D2" of the identity member 4*a*.

A table 2 shows holding statuses of the master rolls 1*c*, 1*d*, 1*e* and 1*f* when the corresponding master roll holding apparatuses hold the master rolls 1*c*, 1*d*, 1*e* and 1*f* respectively. The table 2 also shows holding statuses of the master rolls 1*c*, 1*d*, 1*e* and 1*f* when the corresponding master roll holding apparatuses hold the master rolls 1*c*, 1*d*, 1*e* and 1*f* respectively in reverse direction. In the table 2, "○" shows that the master rolls 1*c*, 1*d*, 1*e* and 1*f* are held on the corresponding master roll holding apparatuses in proper respectively, "Δ" shows that the master rolls 1*c*, 1*d*, 1*e* and 1*f* are held on the corresponding master roll holding apparatuses respectively but with chatter, and "X" shows that the master rolls 1*c*, 1*d*, 1*e* and 1*f* can not be held on the corresponding master roll holding apparatuses respectively.

TABLE 2

| | | | MASTER ROLL HOLDING APPARATUS | | | |
|---|---|---|---|---|---|---|
| | HOLDING DIRECTION | | FIG. 6(A) | FIG. 6(B) | FIG. 6(C) | FIG. 6(D) |
| MASTER ROLL | FIG. 6(A) | RIGHT | ○ | X | Δ | Δ |
| | | REVERSE | X | X | X | X |
| | FIG. 6(B) | RIGHT | X | ○ | Δ | Δ |
| | | REVERSE | X | X | X | X |
| | FIG. 6(C) | RIGHT | X | X | ○ | Δ |
| | | REVERSE | X | X | X | X |
| | FIG. 6(D) | RIGHT | X | X | X | ○ |
| | | REVERSE | X | X | X | X |

As apparent in the table 2, the master roll 1*c* having the identity member 4 and the connecting step 15 shown in FIG. 6(A) can prevent improper set to the conventional master roll holding apparatus shown in FIG. 6(B). The master roll 1*d* having the identity member 4*a* and connecting step 15*a* shown in FIG. 6(B) can prevent improper set to the master roll holding apparatus shown in FIG. 6(A). The master roll 1*e* without connecting step shown in FIG. 6(C) can prevent improper set to the master roll holding apparatus shown in FIGS. 6(A) and (B). Further, the master roll 1*f* without connecting step shown in FIG. 6(D) can prevent improper set to the master roll holding apparatus shown in FIGS. 6(A), (B) and (C).

In other words, the master roll holding apparatus shown in FIG. 6(A) can holds only the master roll 1*c*, and the master roll holding apparatus shown in FIG. 6(B) can holds only the master roll 1*d*.

Further, the master rolls 1*c*, 1*d*, 1*e* and 1*f* shown in FIGS. 6(A), (B), (C) and (D) almost can prevent reverse set to the master roll holding apparatus.

A third embodiment of the present invention is now explained with reference to FIGS. 7 and 8. The same parts as those in the first embodiment are designated by the same reference numerals, and are not again explained herein.

Figure 7:
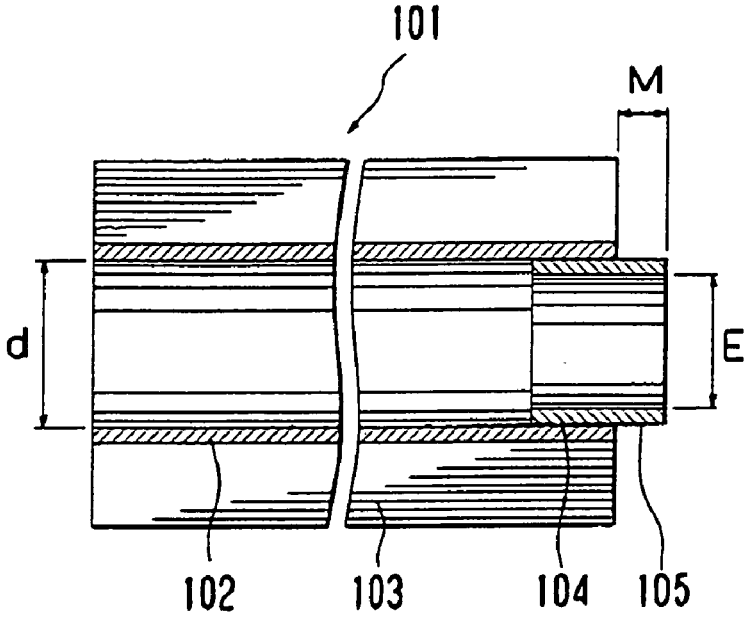
FIG. 7 is an elevational view in section of a master roll according to third embodiment of the present invention.

FIG. 7 is an elevational view in section of a master roll 101 according to third embodiment of the present invention. The master roll 101 is formed by a cylindrical paper core 102 as a cylindrical core formed out of thick paper, a long-formed stencil 103 wound around the paper core 102, and a ling-like identity member 104 inserted into an inner periphery of the paper core 102 from a side thereof. The identity member 104 is adhered to the inner periphery of the paper core 102.

The identity member 104 locates the end portion thereof in the outside portion of the paper core 102 with length "M" so as to make a projection 105. The inner diameter of the paper core 102 is defined "d", and the inner diameter of the identity member 104 is defined "E". The identity member 104 is formed out of thick paper like the paper core 102 in consideration of recycling.

Figure 8:
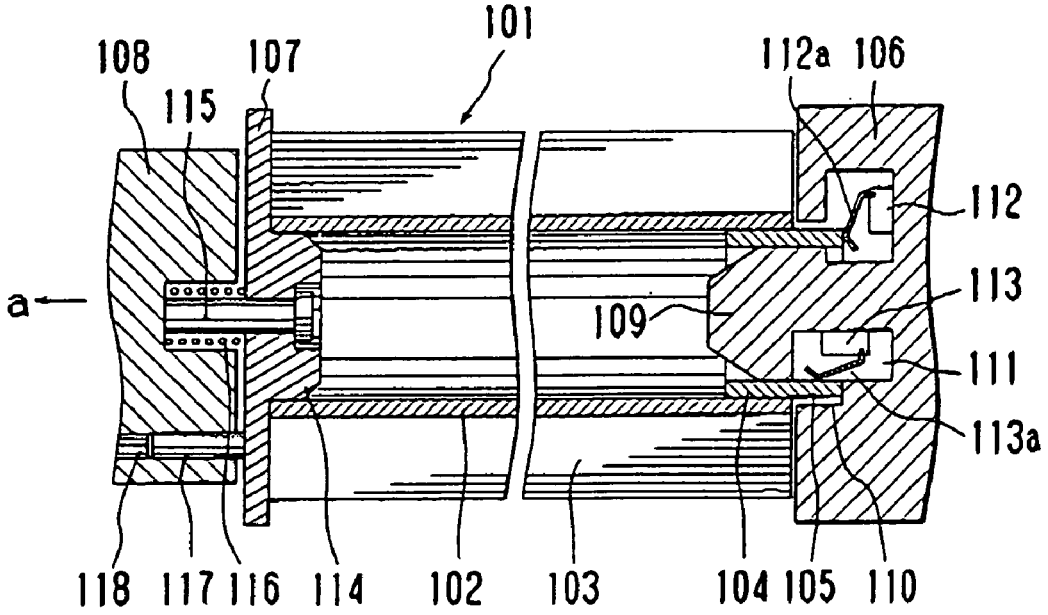
FIG. 8 is an elevational view in section of a master roll holding apparatus holding the master roll according to the third embodiment of the present invention.

FIG. 8 is an elevational view in section of a master roll holding apparatus holding the master roll 101 according to the third embodiment of the present invention. The master roll holding apparatus provides a fixed flange 106 as a master roll holding portion, a movable flange 107, and a holder 108.

The fixed flange 106 provides a convex connector 109 as a detector, which is inserted into the inner periphery of the identity member 104 when the master roll holding apparatus holds the master roll 101. The fixed flange 106 also provides a ling-like concave connector 110 as the detector, which allows the projection 105 of the identity member 104 to insert into the concave connector 110. The concave connector 109 has a depth, which is almost equal to the length "M" of the projection 105. The convex connector 109 has a diameter that is slight smaller than the inner diameter "E" of the identity member 104.

The fixed flange 106 provides an expanded portion 111 connecting to the concave connector 110. The expanded portion 111 provides a length detect sensor 112 and an inner diameter detect sensor 113 as the detectors. The length detect sensor 112 turns on, when the end of the inserted projection 105 pushed a rotary sending plate 112*a* of the length detect sensor 112, so as to detect whether the projection 105 has the length more than length "M". The inner diameter detect sensor 113 turns on, when the inner surface of the inserted projection 105 pushed a rotary sending plate 113*a* of the inner diameter detect sensor 113, so as to detect whether the projection 105 has the inner diameter more than diameter "E". The length detect sensor 112 and the inner diameter detect sensor 113 are connected to the control circuit of a stencil printer (no shown). The control circuit uses the output of the length detect sensor 112 and the inner diameter detect sensor 113 in order to display the dtecting result in a display of the stencil printer (not shown). The control circuit controls the display to show information whether the master roll 101 is proper or improper for the stencil printer. The display can show the information by words, warning such as LED elimination, or the like.

The movable flange 107 provides a convex connector 114 at one side thereof. The convex connector 114 is inserted into the inner periphery of the paper core 102 when the pair of master roll holding portion holds the master roll 101. The convex connector 114 has a diameter that is slight smaller than inner diameter "d" of the paper core 102 provided on corresponding master roll 101.

The holder 108 is movable from a holding position to a release position shown in arrow a in FIG. 8. The movable flange 107 is attached to the holder 108 through a guide rod 115 and a coil spring 116. The movable flange 107 is slidably attached to the guide rod 115 along an axis of the guide rod 115, and is urged to the master roll 101 by the coil spring 116 so as to give a stopping power to rotation of the master roll 101. The movable flange 107 provides a detent pin 117, which is inserted into a detent hole 118 provided on the holder 108 so as to prevent rotation of the movable flange 107.

In operation, the master roll 101 is formed by wind of the stencil 103 around the paper core 102 and insertion of the identity member 104 into the inner periphery of the paper core 102, so that the master roll 101 can be easily manufactured. Many varieties of the master rolls 101, such as the master rolls 101 having different lengths "M" of the identity members 4 but same other portions, also can be easily manufactured due to definition of the length "M" of the identity member 4.

First of all, the holder 108 in the holding position shown in FIG. 8 should be released to the arrow a direction with the movable flange 107 so as to increase the distance between the movable flange 107 and the fixed flange 106, when the operator desires the master roll 101 to be held by the master roll holding apparatus. Next, the master roll 101 should be positioned between the fixed flange 106 and the movable flange 107. Then, the convex connector 114 of the fixed flange 106 should be inserted into the inner periphery of identity member 104 and the projection 105 of the identity member 104 should be inserted into the concave connector 110. The convex connector 114 of the movable flange 107 also should be inserted into the inner periphery of the paper core 102 while the holder 108 is returned to the holding position with the movable flange 107.

The master roll 101 defines the inner diameter "E" of the identity member 4, the outer diameter of the identity member 4, and the length "M" of the projection 105 in accordance with a stencil printer of which the master roll 1 is used. Thus, the convex connector 109 of the fixed flange 106 provided on the master roll holding apparatus of the stencil printer can be smoothly inserted into the inner periphery of the identity member 104 of the master roll 1 without chatter, and the projection 105 of the identity member 104 can be also smoothly inserted into the concave connector 110 of the fixed flange 106, when the master roll 1 is proper for the stencil printer. Further, the end of the projection 105 pushes the rotary sensing plate 112*a* and the inner diameter of the identity member 104 pushes the rotary sensing plate 113*a* so as to swing the rotary sensing plates 112*a* and 113*a*, so that the length detect sensor 112 and the inner diameter detect sensor 113 turn on, when the master roll 101 is proper for the stencil printer. Accordingly, it is easy to confirm whether the master roll 1 is proper or improper for the stencil printer.

When the master roll 101, which the operator desires to mount on the master roll holding apparatus, is improper for the stencil printer providing the master roll holding apparatus, following troubles occur, so that the operator can easily confirm that the master roll 101 is improper for the stencil printer.

(1) The outer diameter of the convex connector 109 is lager than the inner diameter of the identity member 104, so that the convex connector 109 cannot be inserted into the inner periphery of the identity member 104.

(2) The length "M" of the projection 105 is longer than the depth of the concave connector 110, so that a gap is generated between the end of the master roll 103 and the fixed flange 107, when the projection 105 is inserted into the concave connector 110. Further, the movable flange 107 cannot be returned in this case.

(3) The length detect sensor 112 does not turn on because the end of the projection 105 does not reach to the rotary sensing plate 112*a* of the length detect sensor 112, when the length "M" of the projection 105 is shorter than the depth of the concave connector 110.

(4) The inner diameter detect sensor 113 does not turn on because the inner diameter of the projection 105, i.e., inner diameter "E" of the identity member 104 does not reach to the rotary sensing plate 113*a* of the inner diameter detect sensor 113, when the inner diameter "E" of the identity member 104 is lager than the proper diameter thereof.

Consequently, it can be prevented to do plate making and printing operation over from the very beginning after starting the plate making and printing while the improper master roll 101 for the stencil printer is held on the master roll holding apparatus of the stencil printer, so that the loss of the stencil 103 and time can be prevented.

A fourth embodiment of the present invention is now explained with reference to FIG. 9. The same parts as those in the previous embodiments are designated by the same reference numerals, and are not again explained herein.

Figure 9:
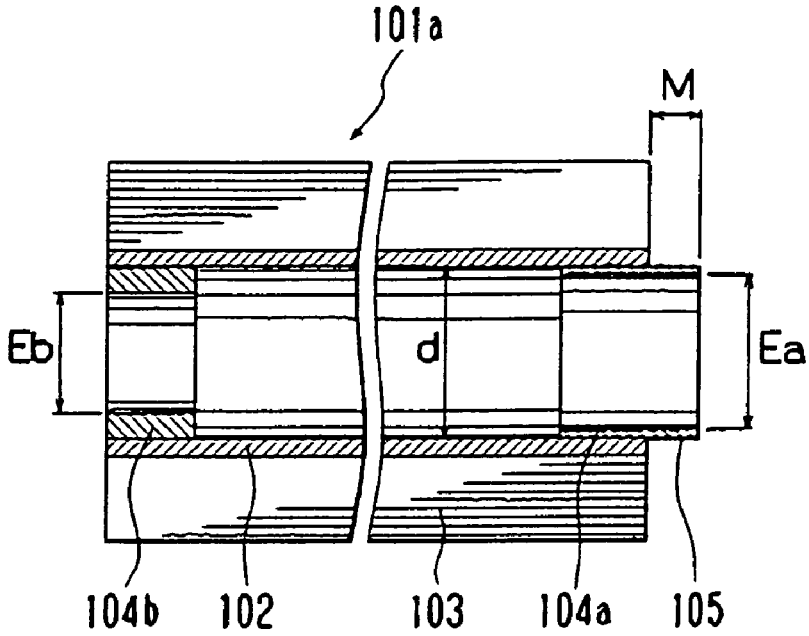
FIG. 9 is an elevational view in section of a master roll according to fourth embodiment of the present invention.

FIG. 9 is an elevational view in section of a master roll according to fourth embodiment of the present invention. The master roll 101*a* is formed by a cylindrical paper core 102 as a cylindrical core formed out of thick paper, a long-formed stencil 103 wound around the paper core 102, and ring-like identity member 104*a* and 104*b* inserted into an inner periphery of the paper core 102 from both sides thereof. The identity member 104*a* and 104*b* are adhered to the inner periphery of the paper core 102.

One identity member 104*a* locates the end portion thereof in the outside portion of the paper core 102 with length "M" so as to make a projection 105. The inner diameter of the paper core 102 is defined "d", and the inner diameter of the identity member 104*a* is defined "Ea". Another identity member 104*b* locates the end portion thereof in the same surface of the end of the paper core 102. The inner diameter of the identity member 104*b* is defined "Eb". The identity members 104*a* and 104*b* are formed out of thick paper like the paper core 102 in consideration of recycling.

In operation, the master roll 101*a* is formed by wind of the stencil 103 around the paper core 102 and insertion of the identity members 104*a* and 104*b* into the inner periphery of the paper core 102, so that the master roll 101*a* can be easily manufactured.

Many varieties of the master rolls 101*a*, such as the master rolls 101*a* having different inner diameters of the identity members 4, the master roll 101*a* having or not having the projection 105, and the master roll 101*a* having different lengths of the projection 105, also can be easily manufactured due to definition of the inner diameter "Ea" and "Eb" of the identity members 104*a* and 104*b*, presence or absence of the projection 105, and definition of the length "M" of the projection 105.

A fifth embodiment of the present invention is now explained with reference to FIGS. 10 and 11. The same parts as those in the first embodiment are designated by the same reference numerals, and are not again explained herein.

Figure 10:
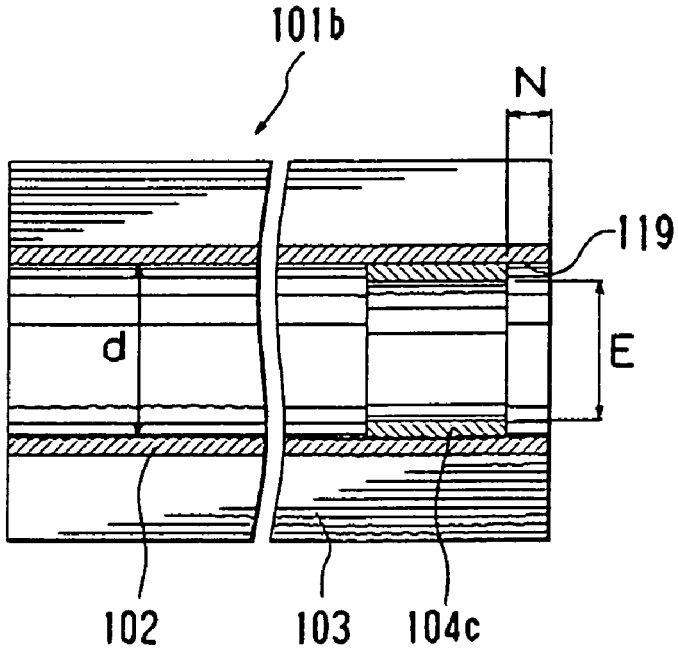
FIG. 10 is an elevational view in section of a master roll according to fifth embodiment of the present invention.

FIG. 10 is an elevational view in section of a master roll 101*b* according to fifth embodiment of the present invention. A master roll 101*b* is formed by a cylindrical paper core 102 as a cylindrical core formed out of thick paper, a long-formed stencil 103 wound around the paper core 102, and a ling-like identity member 104*c* inserted into an inner periphery of the paper core 102 from a side thereof. The identity member 104*c* is adhered to the inner periphery of the paper core 102.

The identity member 104*c* locates the end portion thereof in the inner periphery of the paper core 102 with certain amount so as to make a connecting step 119 from the end the paper core 102 to the end of the identity member 104*c*. The paper core 102 defines its inner diameter as "d". The identity member 104*c* defines its inner diameter as "E". The connecting step 119 defines its depth as "N". The identity member 104*c* is formed out of thick paper like the paper core 102 in consideration of recycling.

Figure 11:
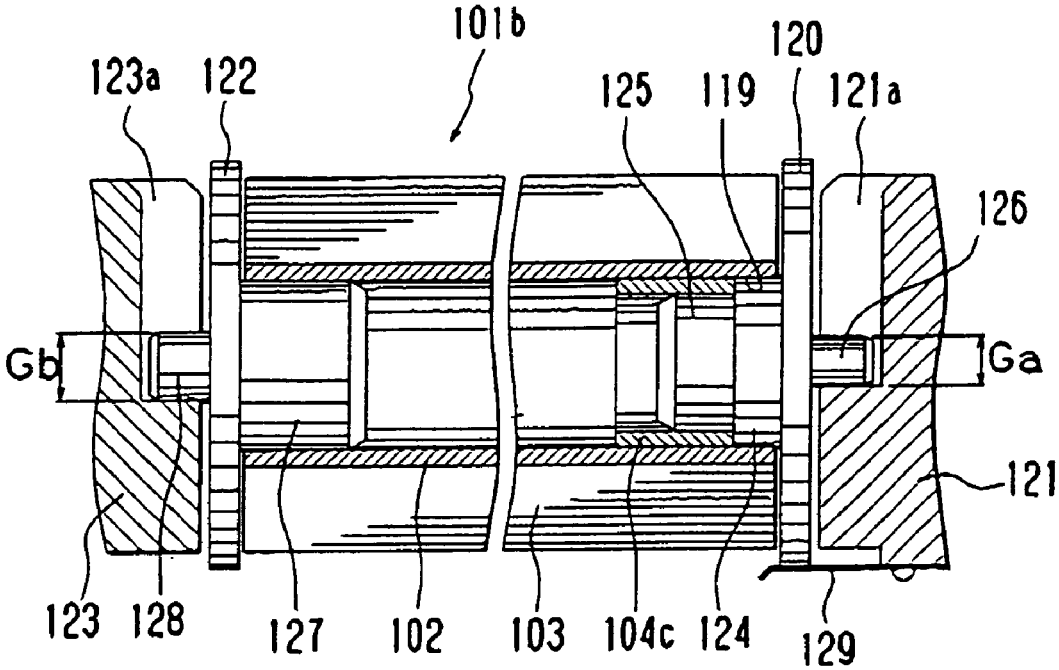
FIG. 11 is an elevational view in section of a master roll holding apparatus holding the master roll according to the fifth embodiment of the present invention.

FIG. 11 is an elevational view in section of a master roll holding apparatus holding the master roll 101*b* according to the fifth embodiment of the present invention. The master roll holding apparatus includes a flange plate 120 for holding one side of the master roll 101*b*, a support table 121 for supporting the flange plate 120, a flange plate 122 for holding another side of the master roll 101*b*, and a support table 123 for supporting the flange plate 122. These flange plates 120 and 122, and the support tables 121 and 123 form the master roll holding portion.

One side of the flange plate 120 provides a first convex connector 124 as a detector and a second convex connector 125 as the detector. The second convex connector 125 is formed on the end of the first convex connector 124. The first convex connector 124 is inserted into the inner periphery of the connecting step 119 and the second convex connector 125 is inserted into the inner periphery of the identity member 104*c*.

Another side of the flange plate 120 provides a support pin 126, which is supported in a support groove 121*a* formed on the support table 121.

The first convex connector 124 has a diameter that is slight smaller than the inner diameter "d" of the paper core 102. The first convex connector 16 also has a length that is almost same to the depth "N" of the connecting step 119. The second convex connector 125 has a diameter that is slight smaller than the inner diameter "E" of the identity member 104*c*. The support pin 126 has a diameter "Ga" that is slight smaller than the width of the support groove 121*a*.

One side of the flange plate 122 provides a convex connector 127, as the detector, which is inserted into the inner periphery of the paper core 102.

Another side of the flange plate 122 provides a support pin 128, which is supported in a support groove 123*a* formed on the support table 123.

The convex connector 127 has a diameter that is slight smaller than the inner diameter "d" of the paper core 102. The support pin 128 has a diameter "Gb" that is slight smaller than the width of the support groove 123*a*.

The support plates 120 and 122 should be attached to the both ends of the master roll 101*b*, and the support pins 126 and 128 should be inserted into the support grooves 121*a* and 123*a*, in order to mount the master roll 101*b* on the master roll holding apparatus. The master roll 101*b* held on the master roll holding apparatus, together with the flange plates 120 and 122, rotates with draw of the stencil 103. The support table 121 provides a leaf spring 129 for urging the outer periphery of the flange plate 120 in order to give stopping power to the rotation of the master roll 101*b*.

In operation, the master roll 101*b* is formed by wind of the stencil 103 around the paper core 102 and insertion of the identity member 104*c* into the inner periphery of the paper core 102, so that the master roll 101*b* can be easily manufactured. Many varieties of the master rolls 101*b*, such as the master rolls 101*b* having different depth "M" of the connecting step 119 but same other portions, also can be easily manufactured due to definition of the depth "N" of the connecting step 119.

The master roll 101*b* defines the inner diameter "E" of the identity member 104*c* and the depth "N" of the connecting step 119 in accordance with a stencil printer, of which the master roll 101*b* is used. Thus, the second convex connector 125 of the flange plate 120 can be smoothly inserted into the inner periphery of the identity member 104*c* of the master roll 101*b* without chatter, the first convex connector 124 of the flange plate 120 can be smoothly inserted into the inner periphery of the paper core 102 of the master roll 101*b* without chatter, the flange plate 120 is positioned along the end of the master roll 101*b*, and the master roll 101*b* with the flange plates 120 and 122 can be supported surely on the support tables 121 and 123, in case the master roll 101*b* is proper for the stencil printer. Accordingly, it is easy to confirm whether the master roll 101*b* is proper or improper for the stencil printer.

When the master 101*b*, which the operator desires to mount on the master roll holding apparatus, is improper for the stencil printer providing the master roll holding apparatus, following troubles occur, so that the operator can easily confirm that the master roll 101*b* is improper for the stencil printer.

(1) The second convex connector 125 cannot be inserted into the inner periphery of the identity member 104*c*, in case the outer diameter of the second convex connector 125 is lager than the inner diameter "E" of the identity member 104*c*.

(2) The flange plate 120 is attached to the master roll 101*b* at certain interval from the side of the master roll 101*b* so as to be enlarge the interval between the flange plates 120 and 122 larger than the interval between the support tables 121 and 123, so that the master roll 102*b* with flange plates 120 and 122 cannot be mounted on the support tables 121 and 123, in case the length of the first convex connector 124 is longer than the depth "N" of the connecting step 119.

Consequently, it can be prevented to do plate making and printing operation over from the very beginning after starting the plate making and printing while the improper master roll 101*b* for the stencil printer is held on the master roll holding apparatus of the stencil printer, so that the loss of the stencil 103 and time can be prevented.

Further, the diameters "Ga" and "Gb" of the support pins 126 and 128 provided on the flange plates 120 and 122 are defined different diameter each other, and the diameters "Ga" and "Gb" of the support pins 126 and 128 are formed slight smaller than the widths of the support grooves 121*a* and 123*a* provided on the support tables 121 and 123 respectively. That is, the support grooves 121*a* and 123*a* cannot accept support pins thicker than the support pins 126 and 128 respectively. Thus, reverse setting of the master roll 101*b* with the flange plates 120 and 122 on the mater roll holding apparatus can be prevented, so that the reverse setting of the stencil 103 on a plate cylinder of the stencil printer also can be prevented.

Figure 12:
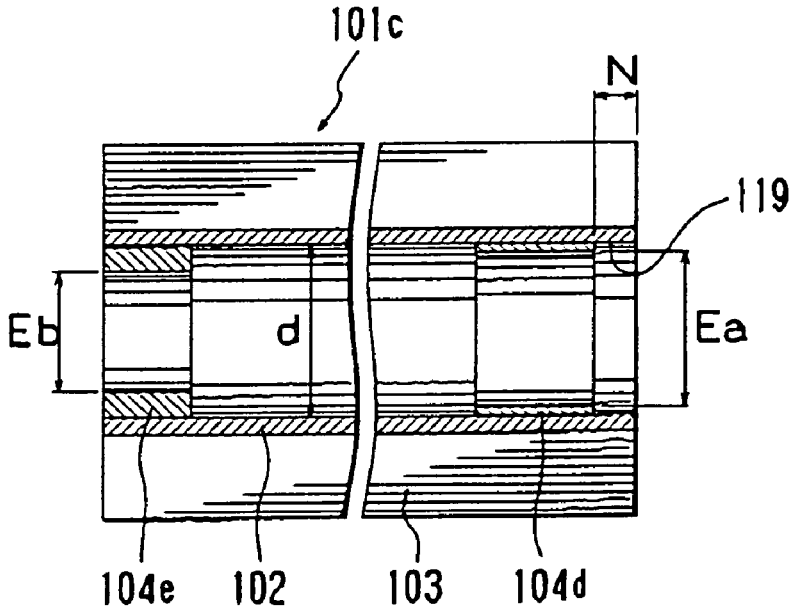
FIG. 12 is an elevational view in section of a master roll according to sixth embodiment of the present invention.

FIG. 12 is an elevational view in section of a master roll 101*c* according to sixth embodiment of the present invention. A master roll 101*c* is formed by a cylindrical paper core 102 as a cylindrical core formed out of thick paper, a long-formed stencil 103 wound around the paper core 102, and ring-like identity members 104*d* and 104*e* inserted into an inner periphery of the paper core 102 from both sides thereof. The identity members 104*d* and 104*e* are adhered to the inner periphery of the paper core 102.

One identity member 104*d* locates the end portion thereof in the inner periphery of the paper core 102 with certain amount so as to make a connecting step 119 from the end the paper core 102 to the end of the identity member 104*d*.

Another identity member 104*e* locates the end portion thereof in the same surface of the end of the paper core 102.

The paper core 102 defines its inner diameter as "d". One identity member 104*d* defines its inner diameter as "Ea". The connecting step 119 defines its depth as "N". Another identity member 104*e* defines its inner diameter as "Eb".

The identity members 104*d* and 104*e* are formed out of thick paper like the paper core 102 in consideration of recycling.

In operation, the master roll 101*c* is formed by wind of the stencil 103 around the paper core 102 and insertion of the identity members 104*d* and 104*e* into the inner periphery of the paper core 102, so that the master roll 101*c* can be easily manufactured.

Many varieties of the master rolls 10*c*, such as the master rolls 101*c* having different inner diameters of the identity members 4, the master roll 101*c* having or not having the connecting step 119, and the master roll 101*c* having different lengths of the connecting step 119, also can be easily manufactured due to definition of the inner diameter "Ea" and "Eb" of the identity members 104*d* and 104*e*, presence or absence of the connecting step 119, and definition of the length "N" of the connecting step 119.

A seventh embodiment of the present invention is now explained with reference to FIGS. 13 and 14. The same parts as those in the first embodiment are designated by the same reference numerals, and are not again explained herein.

Figure 13A:
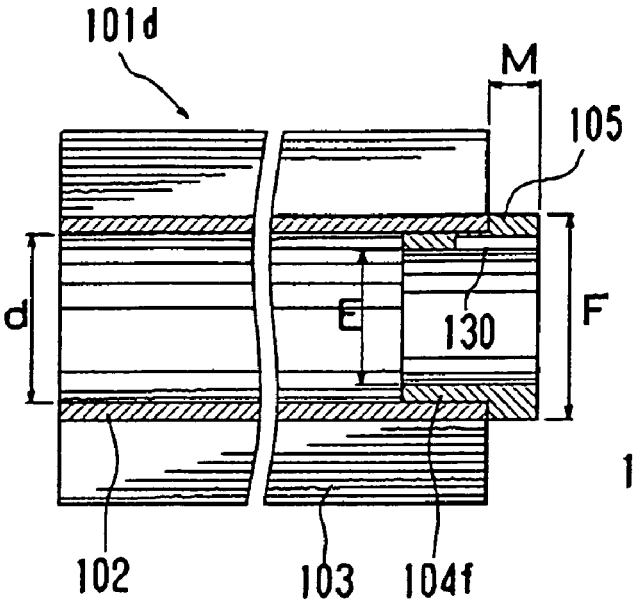
FIG. 13(A) is an elevational view in section of a master roll according to seventh embodiment of the present invention.
Figure 13B:
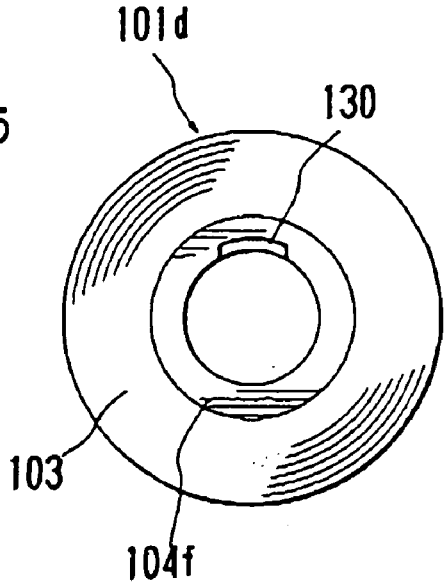
FIG. 13(B) is a side elevational view in section of the master roll according to seventh embodiment of the present invention.

FIG. 13(A) is an elevational view in section of a master roll 101*d* according to seventh embodiment of the present invention. FIG. 13(B) is a side elevational view in section of the master roll 101*d* according to seventh embodiment of the present invention. The master roll 101*d* is formed by a cylindrical paper core 102 as a cylindrical core formed out of thick paper, a long-formed stencil 103 wound around the paper core 102, and a ring-like identity member 104*f* inserted into an inner periphery of the paper core 102 from a side thereof. The identity member 104*f* is adhered to the inner periphery of the paper core 102. The identity member 104*f* may be formed out of synthetic resin. The identity member 104*f* also may be formed out of thick paper like the paper core 102 in consideration of recycling.

The identity member 104*f* locates the end portion thereof in the outside portion of the paper core 102 with length "M" so as to make a projection 105. The identity member 104*f* provides a connecting groove 130 as a detector, which is formed on the inner periphery of the identity member 104*f* from the end of the identity member 104*f*, i.e., the end of the projection 105, along the axis of the paper core 102.

The inner diameter of the paper core 102 is defined "d", the inner diameter of the identity member 104 is defined "E", and the outer diameter of the projection 105 is defined "F".

Figure 14:
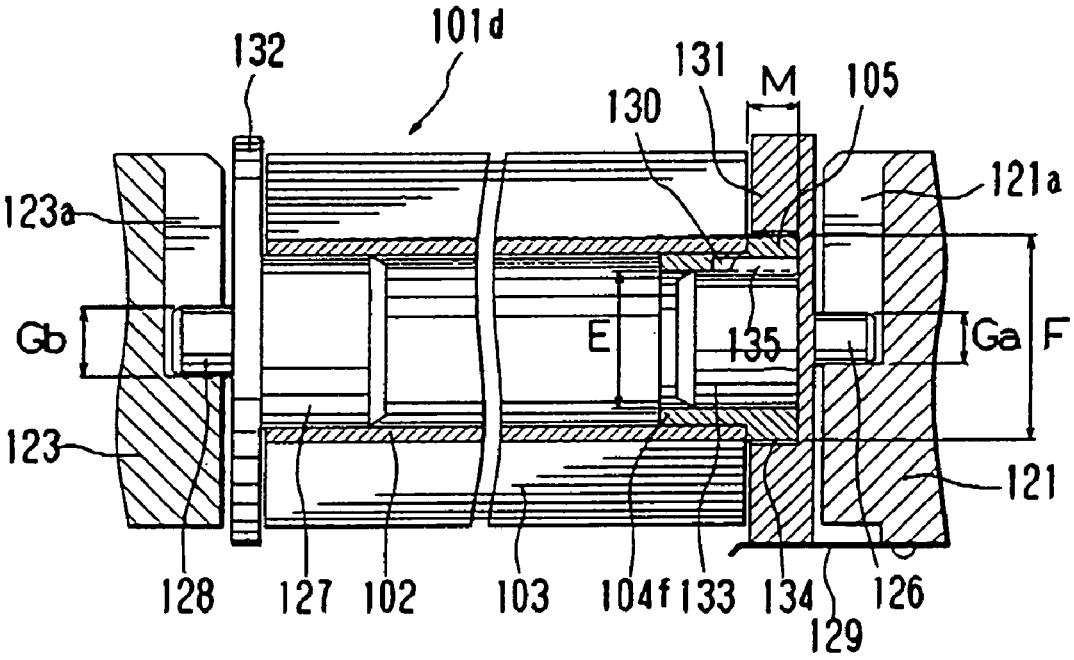
FIG. 14 is an elevational view in section of a master roll holding apparatus holding the master roll according to the seventh embodiment of the present invention.

FIG. 14 is an elevational view in section of a master roll holding apparatus holding the master roll 101*d* according to the seventh embodiment of the present invention. The master roll holding apparatus includes a flange plate 131 for holding one side of the master roll 101*d*, a support table 121 for supporting the flange plate 131, a flange plate 132 for holding another side of the master roll 101*d*, and a support table 123 for supporting the flange plate 132. These flange plates 131 and 132, and the support tables 121 and 123 form the master roll holding portion.

One side of the flange plate 131 provides a convex connector 133, as a detector, which is inserted into the inner periphery of the identity member 104*f*. Same side of the flange plate 131 also provides a ring-like concave connector 134, as the detector, which allows the projection 105 of the identity member 104*f* to insert. The depth of the concave connector 134 is almost same to the length "M" of the projection 105. The inner diameter of the concave connector 134 is defined a diameter that is slightly larger than the outer diameter "F" of the projection 105.

The convex connector 133 provides a convex connector 135 as a detector, which is connected with the connecting groove 130, on the outer peripheral of the convex connector 133. The convex connector 133 is formed in accordance with feature of the connecting groove 130. For instance, if the feature of the connecting groove 130 identifies its width, the width of the concave connector 135 is formed in accordance with the width of the connecting groove 130. If the feature of the connecting groove 130 identifies its number, the number of the concave connector 135 is formed in accordance with the number of the connecting groove 130.

Another side of the flange plate 131 provides a support pin 126, which is supported in a support groove 121*a* formed on the support table 121.

One side of the flange plate 132 provides a convex connector 127, as the detector, which is inserted into the inner periphery of the paper core 102.

Another side of the flange plate 132 provides a support pin 128, which is supported in a support groove 123*a* formed on the support table 123.

The support plates 131 and 132 should be attached to the both ends of the master roll 101*d*, and the support pins 126 and 128 should be inserted into the support grooves 121*a* and 123*a*, in order to mount the master roll 101*d* on the master roll holding apparatus. The master roll 101*d* held on the master roll holding apparatus, together with the flange plates 131 and 132, rotates with draw of the stencil 103. The support table 121 provides a leaf spring 129 for urging the outer periphery of the flange plate 131 in order to give stopping power to the rotation of the master roll 101*d*.

In operation, the master roll 101*d* is formed by wind of the stencil 103 around the paper core 102 and insertion of the identity member 104*f* into the inner periphery of the paper core 102, so that the master roll 101*d* can be easily manufactured. Many varieties of the master rolls 101*d*, such as the master rolls 101*d* having different number of the connecting grooves 130 or different width of the connecting groove 130 but same other portions, also can be easily manufactured due to definition of the number or width of the connecting groove 130.

The master roll 101*d* defines the inner diameter "E" of the identity member 104*f*, the length "M" of the projection 105, number of the connecting groove 130, and width of the connecting groove 130 in accordance with a stencil printer, of which the master roll 101*d* is used. Thus, the convex connector 133 of the flange plate 131 can be smoothly inserted into the inner periphery of the identity member 104*f* of the master roll 101*d* without chatter, the projection 105 can be smoothly inserted into the concave connector 134, the convex connector 135 can be smoothly inserted into the connecting groove 130, the flange plate 131 is positioned along the end of the master roll 101*d*, and the master roll 101*d* with the flange plates 131 and 132 can be supported surely on the support tables 121 and 123, in case the master roll 101*d* is proper for the stencil printer. Accordingly, it is easy to confirm whether the master roll 101*d* is proper or improper for the stencil printer.

When the master roll 101*d*, which the operator desires to mount on the master roll holding apparatus, is improper for the stencil printer providing the master roll holding apparatus, following troubles occur, so that the operator can easily confirm that the master roll 101*d* is improper for the stencil printer.

(1) The convex connector 133 cannot be inserted into the inner periphery of the identity member 104*f*, in case the outer diameter of the convex connector 133 is lager than the inner diameter "E" of the identity member 104*f*.

(2) The flange plate 131 is attached to the master roll 101*d* at certain interval from the side of the master roll 101*d* so as to be enlarge the interval between the flange plates 131 and 132 larger than the interval between the support tables 121 and 123, so that the master roll, 102*d* with flange plates 131 and 132 cannot be mounted on the support tables 121 and 123, in case the length of the projection 105 is longer than the depth "M" of the concave connector 134.

(3) The outer diameter "F" of the projection 105 cannot be inserted into the concave connector 134, in case the outer diameter "F" of the projection 105 is larger than the inner diameter of the concave connector 134.

(4) The convex connector 135 cannot be inserted into the connecting groove 130, in case the width of the convex connector 135 is lager than the width of the connecting groove 130 or the number of the convex connector 135 is outnumber of the connecting groove 130.

Consequently, it can be prevented to do plate making and printing operation over from the very beginning after starting the plate making and printing while the improper master roll 101*d* for the stencil printer is held on the master roll holding apparatus of the stencil printer, so that the loss of the stencil 103 and time can be prevented.

The connecting groove 130 is provided one with certain width in this embodiment. However, this is only example. The connecting groove 130 can be provided more than one. Also the width of the connecting groove 130 can be changed.

An eighth embodiment of the present invention is now explained with reference to FIGS. 15 to 18. The same parts as those in the first embodiment are designated by the same reference numerals, and are not again explained herein.

Figure 15:
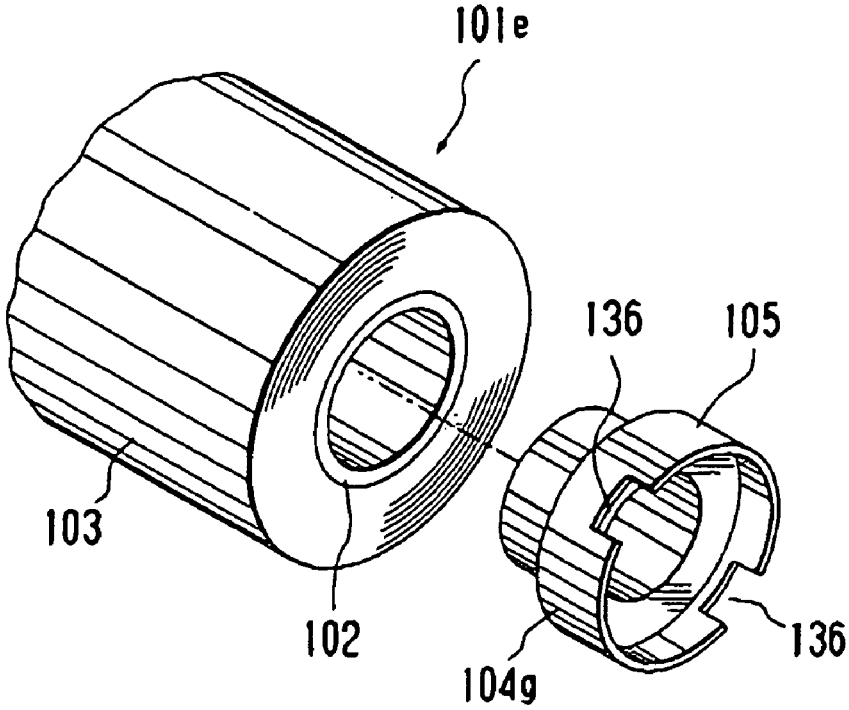
FIG. 15 is an elevational view in section of a master roll according to eighth embodiment of the present invention.

FIG. 15 is an elevational view in section of a master roll 101*e* according to eighth embodiment of the present invention. The master roll 101*d* is formed by a cylindrical paper core 102 as a cylindrical core formed out of thick paper, a long-formed stencil 103 wound around the paper core 102, and a ring-like identity member 104*g* inserted into an inner periphery of the paper core 102 from a side thereof. The identity member 104*g* is adhered to the inner periphery of the paper core 102. The identity member 104*g* may be formed out of synthetic resin. The identity member 104*f* also may be formed out of thick paper like the paper core 102 in consideration of recycling.

Figure 16:
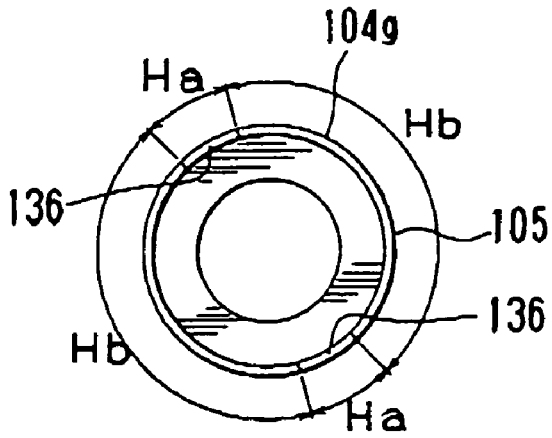
FIG. 16 is a side view of an identity member according to eighth embodiment of the present invention.

FIG. 16 is a side view of an identity member 104*g* according to eighth embodiment of the present invention.

The identity member 104*g* locates the end portion thereof in the outside portion of the paper core 102 with certain length so as to make a projection 105. The identity member 104*g* provides two slits 136 as a detector along the axis of the paper core 102. As shown in FIG. 16, each slit 136 has certain width "Ha", and the interval of the slits 136 are defined "Hb".

Figure 17:
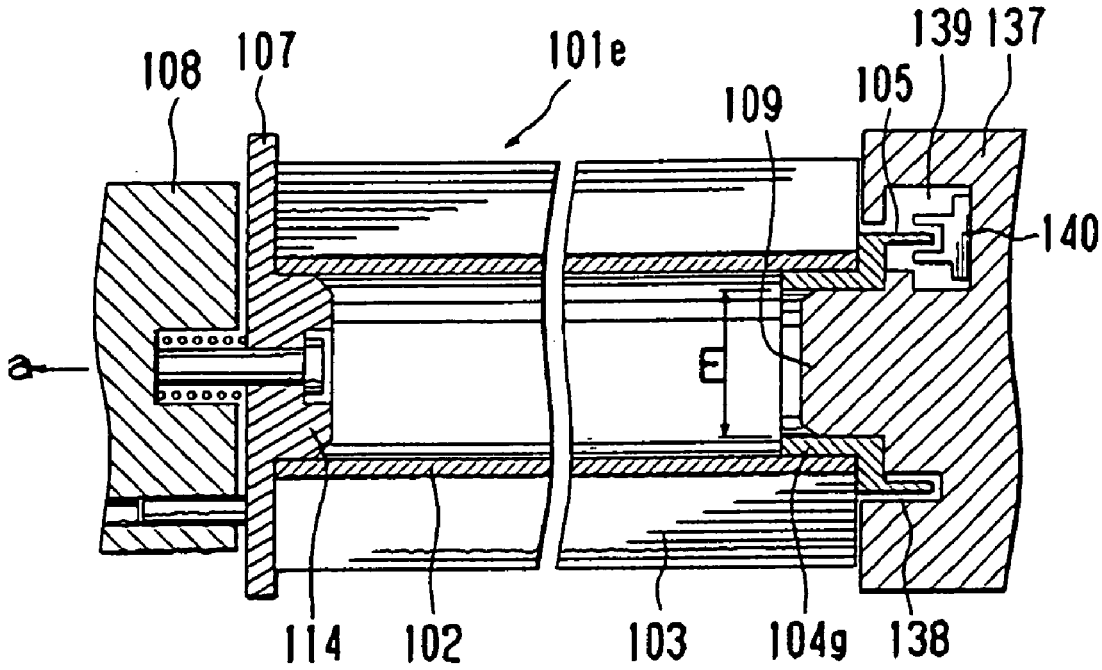
FIG. 17 is an elevational view in section of a master roll holding apparatus holding the master roll according to the eighth embodiment of the present invention.

FIG. 17 is an elevational view in section of a master roll holding apparatus holding the master roll 101*e* according to the eighth embodiment of the present invention. The master roll holding apparatus provides a fixed flange 137, a movable flange 107, and a holder 108. These fixes flange 137, movable flange 107, and holder 108 forms the master roll holding portion.

The fixed flange 137 provides a convex connector 109 as a detector, which is inserted into the inner periphery of the identity member 104*g* when the master roll holding apparatus holds the master roll 101*e*. The fixed flange 137 also provides a ring-like concave connector 138 as the detector, which allows the projection 105 of the identity member 104*g* to insert.

Figure 18:
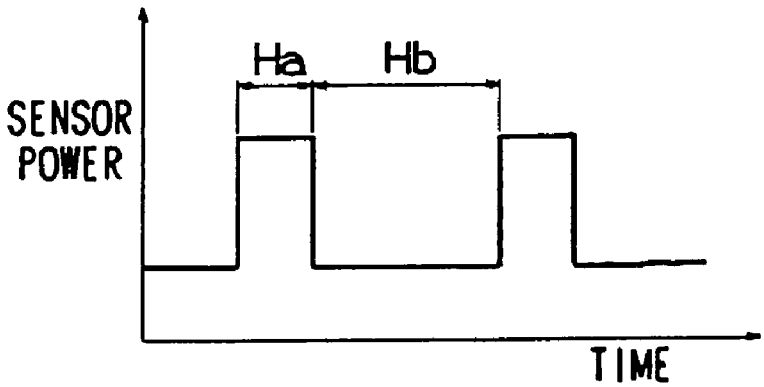
FIG. 18 is a wave form chart output from a slit detect sensor.
Figure 19:
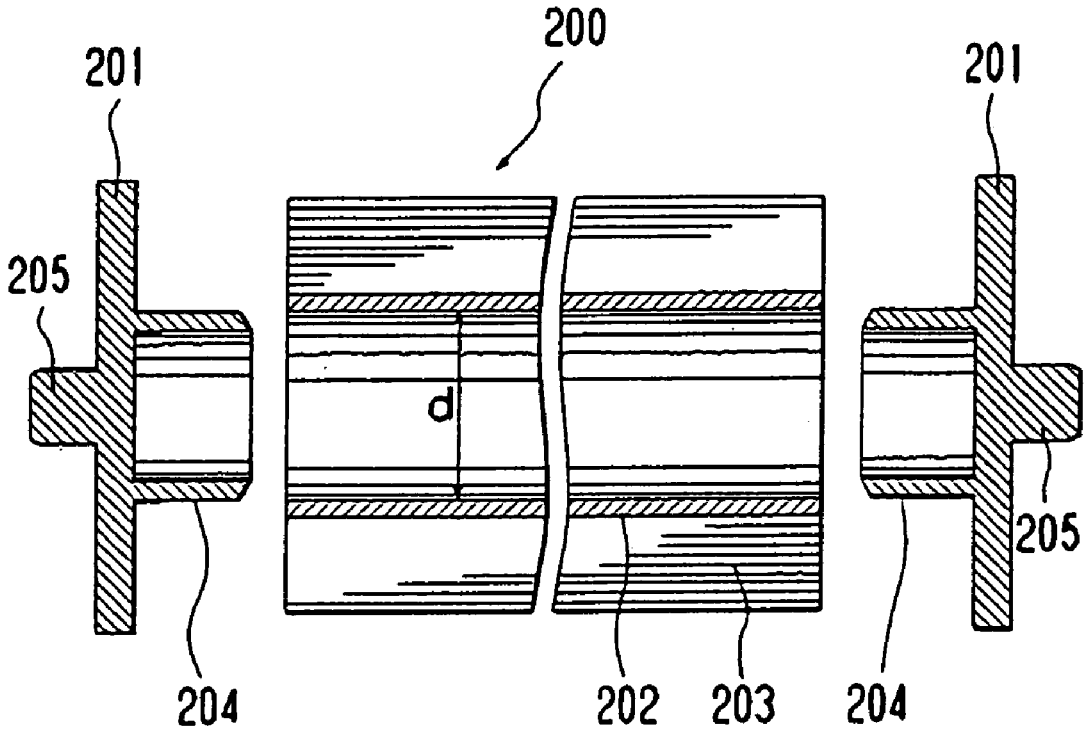
FIG. 19 is an fragmentary elevational view in section of a conventional master roll and a master roll holding apparatus.

The fixed flange 137 provides an expanded portion 139 connecting to the concave connector 138. The expanded portion 139 provides a slit detect sensor 140. The slit detect sensor 140 detects the slits 136 formed on the projection 105. That is, the slit detect sensor 140 outputs signal such as FIG. 18. FIG. 18 is a wave form chart output from a slit detect sensor 136. As shown in FIG. 18, the output from the slit detect sensor 140 becomes high (Ha) when the slit detect sensor 140 detected the slit 136, and the same becomes low (Hb) when the slit detect sensor 140 does not detect the slit 136.

The slit detect sensor 140 is connected to the control circuit of a stencil printer (no shown). The control circuit uses the output of the slit detect sensor 140 in order to display the dtecting result in a display of the stencil printer (not shown). The control circuit controls the display to show information whether the master roll 101 is proper or improper for the stencil printer. The display can show the information by words, warning such as LED elimination, or the like.

Further, the detection based on the output from the slit detect sensor 140 by the control circuit is executed according to feature of the slits 136. For instance, control circuit detects the width of the slits 136, if the width of the slits 136 identifies the feature of the slits 136. The control circuit detects the number of the slits 136, if the number of the slits 136 identifies the feature of the slits 136.

In operation, the master roll 101*e* is formed by wind of the stencil 103 around the paper core 102 and insertion of the identity member 104*g* into the inner periphery of the paper core 102, so that the master roll 101*e* can be easily manufactured. Many varieties of the master rolls 101*d*, such as the master rolls 101*d* having different number of the slits 136 or different width of the slit 136 but same other portions, also can be easily manufactured due to definition of the number or width of the slit 136.

First of all, the holder 108 in the holding position shown in FIG. 17 should be released to the arrow a direction with the movable flange 107 so as to increase the distance between the movable flange 107 and the fixed flange 137, when the operator desires the master roll 101*e* to be held by the master roll holding apparatus. Next, the master roll 101*e* should be positioned between the fixed flange 137 and the movable flange 107. Then, the convex connectors 109 of the fixed flange 137 should be inserted into the inner periphery of the identity member 4 and the projection 105 should be inserted into the concave connector 138. The convex connector 114 of the movable flange 107 also should be inserted into the inner periphery of the paper core 102 while the holder 108 is returned to the holding position with the movable flange 107.

The master roll 101*e* defines the inner diameter "E" of the identity member 104*g*, number of the slits 136, and width of the slits 136 in accordance with a stencil printer, of which the master roll 101*e* is used. Thus, the convex connector 109 of the fixed flange 137 can be smoothly inserted into the inner periphery of the identity member 104*g* of the master roll 101*e* without chatter, the projection 105 can be smoothly inserted into the concave connector 138, in case the master roll 101*e* is proper for the stencil printer.

Further, the slit detect sensor 140 can detect the slits 136 by rotation of the master roll 101*e* held on the master roll holding apparatus. The detecting result is shown in the display of the stencil printer. Thus, the operator can easily confirm, through the display, whether the master roll 101*e* is proper or improper for the stencil printer.

Consequently, it can be prevented to do plate making and printing operation over from the very beginning after starting the plate making and printing while the improper master roll 101*e* for the stencil printer is held on the master roll holding apparatus of the stencil printer, so that the loss of the stencil 103 and time can be prevented.

The slits 136 are provided two with width "Ha" in this embodiment. However, these are only example. The slit 136 can be provided only one or more than two. Also the width of the slits 136 can be changed.

The present invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embraced therein.

The present application is based on Japanese Priority Documents Hei 11-239141 filed on Aug. 26, 1999 and 2000–140580 filed on May 12, 2000, the content of which are incorporated herein by reference.

What is claimed is:

1. A master roll, comprising:

a core;

a stencil disposed on the core; and a first identity member disposed within an inner periphery of the core adjacent a first end of the core, the first identity member having a first mounting feature corresponding to a variety of the stencil; and a second identity member disposed within the inner periphery of the core adjacent a second end of the core opposite the first end, the second identity member having a second mounting feature corresponding to the variety of the stencil, the second mounting feature different from the first mounting feature, wherein the first identity member is disposed apart from the first end of the core and the second identity member is disposed apart from the second end of the core.

2. The master roll according to claim 1, wherein the first and second identity members define different inner diameters as the first and second mounting features.

3. The master roll according to claim 1, wherein the first identity member comprises a ring-like member.

4. The master roll according to claim 3, wherein the second identity member comprises a ring-like member.

5. The master roll according to claim 1, wherein the core comprises a cylindrical core.

6. The master roll according to claim 1, wherein the stencil comprises a long-formed stencil.

7. The master roll according to claim 1, wherein the stencil is wound on the core.

8. A master roll holder, comprising:

a pair of master roll holding portions configured to hold both sides of a master roll, the master roll comprising:

a core;

a stencil disposed the core; and a first identity member disposed within an inner periphery of the core adjacent a first end of the core, the first identity member having a first mounting feature corresponding to a variety of the stencil; and a second identity member disposed within the inner periphery of the core adjacent a second end of the core opposite the first end, the second identity member having a second mounting feature corresponding to the variety of the stencil, the second mounting feature different from the first mounting feature; and a first detector comprising a first detector feature configured to permit mounting of the master roll on the first detector when the first detector feature corresponds to the first mounting features, wherein the first identity member is disposed apart from the first end of the core and the second identity member is disposed apart from the second end of the core.

9. The master roll holder according to claim 8, wherein the first detector comprises a convex connector as the first detector feature configured to be inserted into the first identity member, the convex connector having a diameter smaller than an inner diameter of the first identity member.

10. The master roll holder according to claim 8, wherein the first and second identity member define different inner diameters as the first and second mounting features, and wherein the first detector and a second detector comprise convex connectors as the first detector feature and as a second detector feature configured to be inserted into the first and second identity members, the convex connectors having diameters smaller than inner diameters of the first and second identity members.

11. The master roll holder according to claim 8, wherein the first and second identity members define inner diameters as the first and second mounting features, and wherein the first detector is disposed at the master roll holding portion, the first detector comprising a convex connector as the first detector feature configured to be inserted into the first identity member, the convex connector having a diameter smaller than an inner diameter of the first identity member.

12. The master roll according to claim 8, wherein the first detector comprises:

a first convex connector configured to be inserted into the core; and a second convex connector connected to the first convex connector and configured to be inserted into the first identity member.

13. The master roll holder according to claim 8, wherein the first identity member comprises a ring-like member.

14. The master roll holder according to claim 13, wherein the second identity member comprises a ring-like member.

15. The master roll holder according to claim 8, wherein the core comprises a cylindrical core.

16. The master roll holder according to claim 8, wherein the stencil comprises a long-formed stencil.

17. The master roll holder according to claim 8, wherein the stencil is wound on the core.

18. A roll, comprising:

a core;

a stencil disposed on the core; and a first identity member disposed in an interior of the core and having a first mounting feature; and a second identity member disposed in an interior of the core and having a second mounting feature different from the first mounting feature, wherein the first identity member is disposed away from ends of the core.

19. The roll according to claim 18, wherein the first and second mounting features comprise interior diameters of the first and second identity members.

20. The roll according to claim 18, wherein the second identity member is disposed away from the ends of the core.

21. The roll according to claim 18, wherein the first and second identity members comprise annular members.

* * * * *